US005555661A

United States Patent [19]

Yap

[11] Patent Number: 5,555,661

[45] Date of Patent: Sep. 17, 1996

[54] PISTOL GRIP MAGAZINE ADAPTOR

[76] Inventor: Edwin Yap, 9092 Talbert Ave., # 11, Fountain Valley, Calif. 92708

[21] Appl. No.: 356,704

[22] Filed: Dec. 15, 1994

[51] Int. Cl.[6] ..... F41A 9/71

[52] U.S. Cl. ..... 42/49.02; 42/50; 42/7

[58] Field of Search ..... 89/34; 42/7, 50, 42/49.01, 49.02

[56] References Cited

U.S. PATENT DOCUMENTS

| | | | |
|---|---|---|---|
| 3,732,643 | 5/1973 | Wells | 42/50 |
| 4,835,892 | 6/1989 | Ruger et al. | 42/7 |
| 4,899,476 | 2/1990 | Hindle | 42/7 |
| 5,253,442 | 10/1993 | Kim | 89/34 |

FOREIGN PATENT DOCUMENTS

| | | | |
|---|---|---|---|
| 627305 | 10/1978 | U.S.S.R. | 42/7 |

*Primary Examiner*—Stephen M. Johnson
*Attorney, Agent, or Firm*—Dennis W. Beech

[57] ABSTRACT

The pistol grip magazine adapter provides an insert for the magazine in the handles of hand guns. The insert is designed to fit snugly in the pistol magazine and is of a proper volume or density to reduce the space in the magazine such that only a single row ammunition clip will fit. The insert is attached to the inside walls of the magazine, is an element of the pistol grips or is attached to the bullet clip. With the space reduction, standard single row clips holding up to ten rounds of ammunition may be inserted. However, the higher capacity clips, such as twenty rounds, for which the gun was originally designed will no longer fit. The inserts are formed from one or two pieces of material depending on the particular hand gun requiring the insert.

1 Claim, 5 Drawing Sheets

PISTOL GRIP MAGAZINE ADAPTOR

BACKGROUND OF THE INVENTION

1. Field of the Invention

This invention relates to hand guns and more specifically to the projectile magazine in the handle of hand guns. The new device provides a simple means to modify handle magazine funnels so they can only accept ten or less bullet clips. Alternatively an adapter is attached to the magazine clip to allow a ten or less bullet clip to be used in the high capacity magazine.

2. Description of Related Art

There are currently in use many varieties of hand guns. Slide action hand guns as compared to revolvers normally have a magazine clip which slides in and is retained in a magazine formed in the handle of the gun. Many of these hand guns were designed and manufactured to hold bullet clips of more than ten bullets. Common examples are the Caspian 45 caliber, the STI hi-capacity pistol, the Barretta, Ruger, Walther and many others.

Currently in the United States all hand guns are required to have magazine bullet clip capacities of ten rounds or less. For higher capacity gun magazines the common twenty bullet clip and others over ten rounds must be modified by inserting a plug in the clip or manufacturing shorter clips with solid ends. This essentially allows only ten bullets to be loaded in these two row bullet clips.

The present invention provides a simple insert for the magazine funnel of hand guns designed to hold more than ten rounds of ammunition. The insert fits in the existing hand gun magazine in a manner which narrows the interior such that only a single row bullet clip magazine will fit. If the overall volume must be reduced to hold the clip firm this is also accomplished. The result is that existing inexpensive ten bullet clips such as the standard 1911 type clip for 45 caliber and 9 mm may be used in existing hand guns in conformance with the law. Alternatively an adapter is attached to the bullet clips to allow the ten round or less clip to be used in existing higher capacity magazine funnels.

SUMMARY OF THE INVENTION

A primary objective of the present invention is to reduce the volume of hand gun magazines such that they can only received ten round or less magazine clips. Another object of the invention is to adapt existing ten round or less magazine clips so they will fit in existing higher capacity pistol magazine wells.

In accordance with the description presented herein, other objectives of this invention will become apparent when the description and drawings are reviewed.

DESCRIPTION OF THE PREFERRED EMBODIMENT

Figure 2:
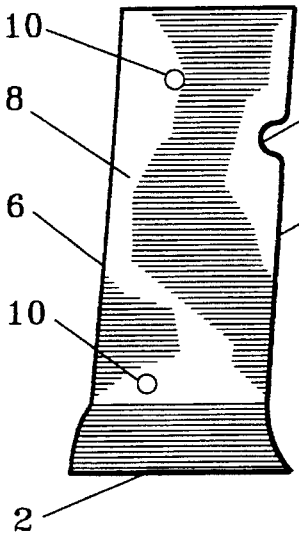
FIG. 2 illustrates a left side view of the single magazine insert.
Figure 1:
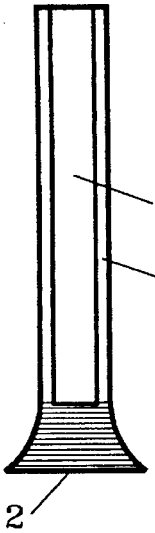
FIG. 1 illustrates a rear view of the single magazine insert.
Figure 3:
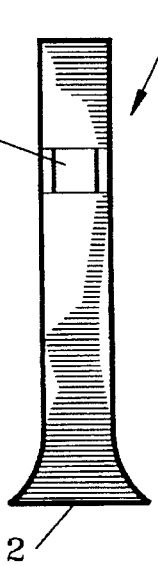
FIG. 3 illustrates a right side view of the single magazine insert.
Figure 4:
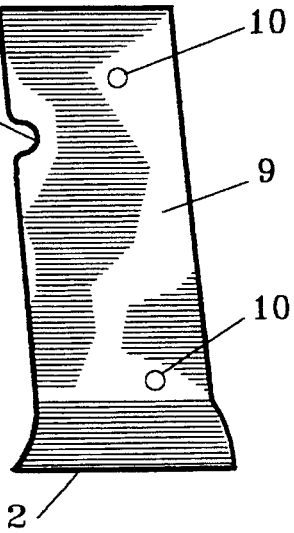
FIG. 4 illustrates a front view of the single magazine insert.
Figure 15:
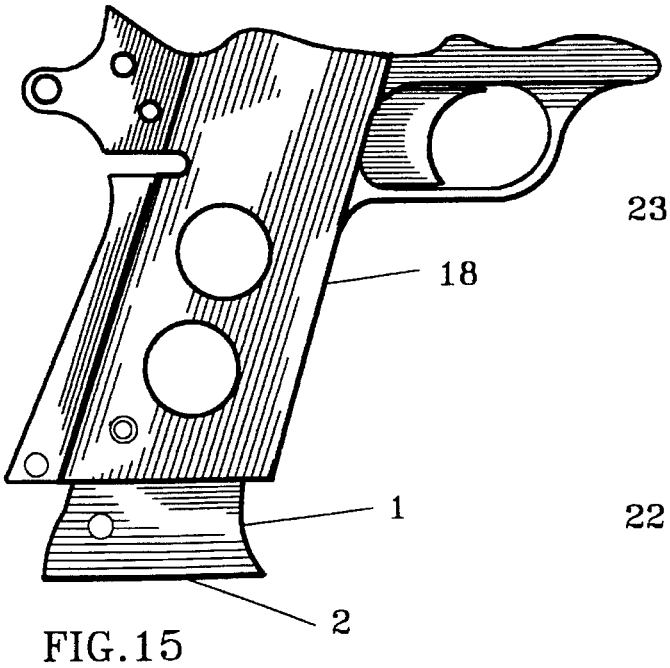
FIG. 15 illustrates a partial side view of a pistol handle with the single insert partially inserted.
Figure 16:
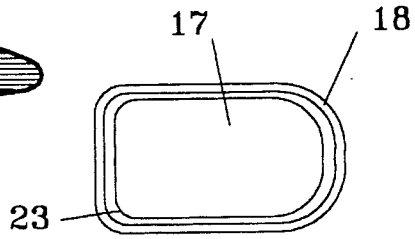
FIG. 16 illustrates a bottom view of a pistol handle magazine funnel.
Figure 17:
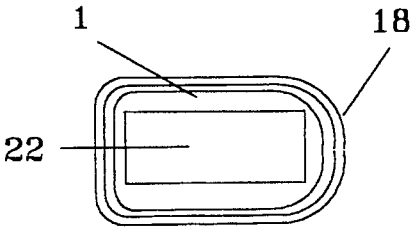
FIG. 17 illustrates a bottom view of a pistol handle magazine with single insert.

The pistol grip magazine adapter is generally a one or two element magazine insert which fits in the hand gun handle magazine space or funnel. The magazine insert narrows the space in the handle magazine to a volume which allows only single clip magazines to fit in and be retained in the handle magazine. In those cases where necessary, the magazine insert also reduces the front to back space to provide a firm fit of the clip in the magazine. An alternate embodiment uses modified pistol grip elements to narrow the space. An additional embodiment attaches the magazine adapter to the magazine clip for insertion into the pistol grip magazine well.

Referring to FIGS. 1 through 5 and 15 through 17, a single element magazine insert (1) is shown. The single insert (1) is generally rectangular in shape with a flared bottom (2) to fit in the typical 45 caliber pistol magazine such as a CASPIAN hand gun. The outside dimensions of the single insert (1) are such as to fit snugly in the magazine space (17) of the intended hand gun.

Other elements of the single insert (1) include inside dimensions necessary to allow the insertion of the bullet clip (3) normally holding ten rounds of ammunition. In the illustrated single insert (1) there is an aperture (4) in the front side (5) to provide for the magazine catch access in the pistol magazine (18). There is also a rectangular aperture (6) in the rear face (7) of the single insert (1) for proper seating of the bullet clip (3).

The right side (8) and left side (9) have attachment apertures (10) to permanently attach the single insert (1) in the hand gun magazine (18) by use of screws or rivets. Other attachment methods may be used such as permanent bonding or welding. However, properly placed attachment apertures (10) may be used in cooperation with screws threaded through the pistol grip elements on a hand gun.

Referring to FIGS. 6 through 10, 12 through 14 and 18, a dual element magazine insert (11) is illustrated. The dual insert (11) is generally rectangular in shape with a tapered top (12) to fit in those hand gun magazines (18) with the taper internal. In the dual insert (11) illustrated, no front to back volume reduction is necessary to adjust for the single row ten round magazine clip (3). However, a right side insert (13) and left side insert (14) are required. These inserts are generally shaped to fit snugly into the particular pistol magazine (18) design, such as in the illustrated case for the 45 caliber STI hand gun. For this particular application, in addition to the tapered top (12), the longer dimensional end (15) is curved in an arch. The combination of the right side insert (13) and left side insert (14) serve to reduce the volume of the pistol handle magazine such that only single row ten round clips (3) may be inserted.

The right side insert (13) and left side insert (14) have attachment apertures (10) to permanently attach the dual insert (11) elements in the hand gun magazine (18) by use of screws or rivets. Again, other attachment methods may be used such as permanent bonding or welding.

Figure 11:
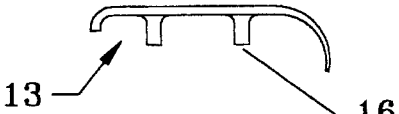
FIG. 11 illustrates a alternate left side dual magazine insert top view.
Figure 9:
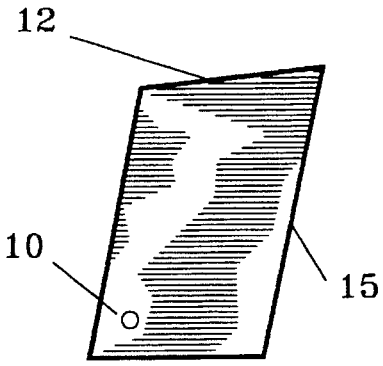
FIG. 9 illustrates a left side dual magazine insert side view.
Figure 19:
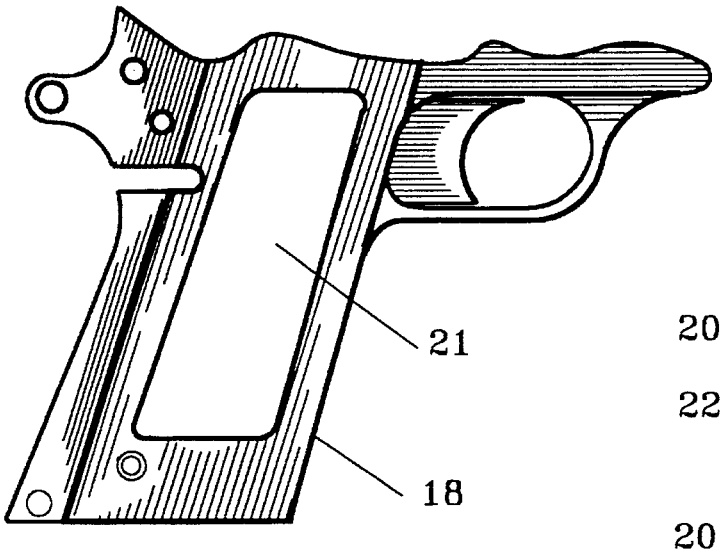
FIG. 19 illustrates a partial side view with pistol handle openings.
Figure 20:
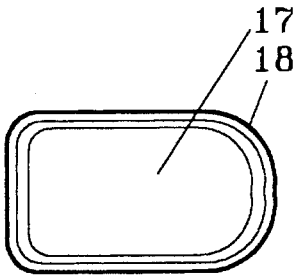
FIG. 20 illustrates a bottom view of a pistol handle magazine funnel.
Figure 21:
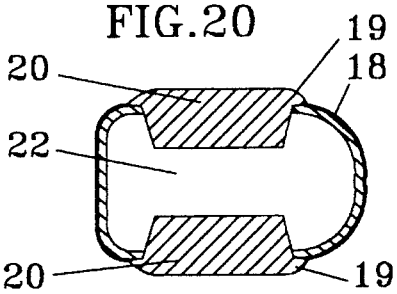
FIG. 21 illustrates a sectional bottom view of a pistol handle magazine with pistol grip inserts.
Figure 22:
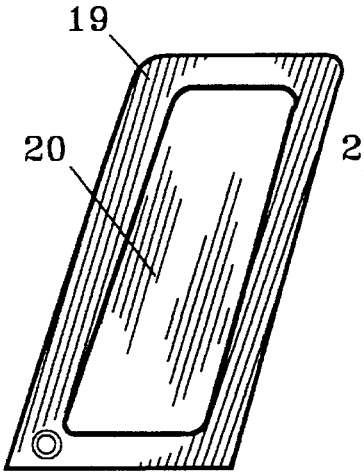
FIG. 22 illustrates a side view of a pistol grip insert.
Figure 23:
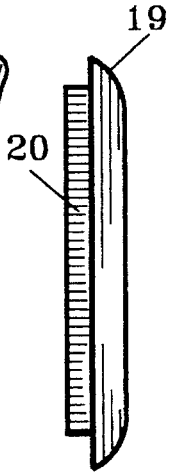
FIG. 23 illustrates an end view of a pistol grip insert.
Figure 24:
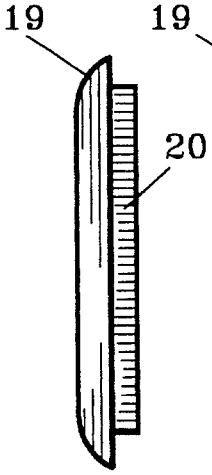
FIG. 24 illustrates an end view of the alternate pistol grip insert.
Figure 25:
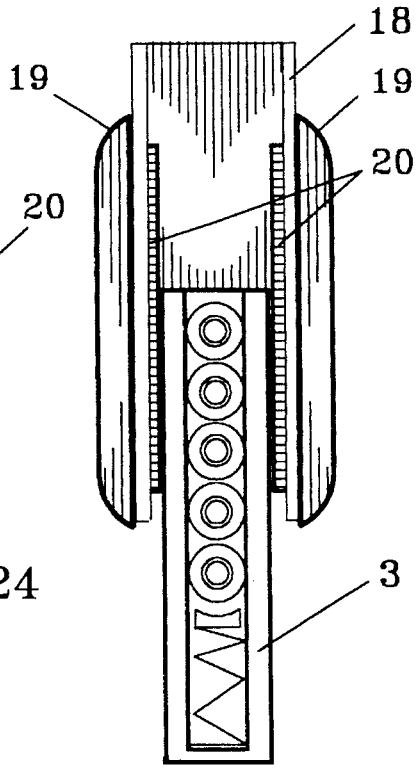
FIG. 25 illustrates a section view of the pistol handle with pistol grip inserts and a magazine ammunition clip partially installed.

Referring to FIG. 11, an alternate dual insert (11) is shown wherein the side inserts are formed of sheet material such as metal or plastic rather than being a solid insert as illustrated in FIGS. 6 through 10. As before the dual inserts (11) would be shaped to fit the magazine (18) and reduce the volume for single clip (3) use. However, pedestals (16) would be attached to space the inserts (11) from the magazine wall and where necessary specific inserts (11) would have attachment apertures (10) for attachment to the magazine (18).

The industry common bullet clip for a single row ten round container is commonly referred to as the 1911 size. The particular volume reduction for these clips would be the size design for the pistol grip adapter. If other caliber hand guns with appropriate size magazines are to be accommodated, the single or dual insert most appropriate for the particular manufacturer would be used. Examples include the 9.00 mm Barretta, Rugar P85 Series, Para-Ordinance, Strayer Tripps, Caspian Arms, SIG P226, HK-P7 M13, Walther P88 and other high capacity magazine hand guns. Other examples of magazines are 225, P7 M8, 92 FSC Type M and 84 Series. The intent is to provide the adapter shaped to fit the walls of the specific pistol magazine with an insert space remaining suitable only for single column, ten round or less magazine clips.

An alternate embodiment of the pistol grip magazine adapter is illustrated in FIG. 19 through 25. The pistol grips (19) normally attached to the pistol magazine (18) have spacer pedestals (20) which when mounted to the pistol magazine (18) protrude through the pistol magazine openings (21) into the magazine space (17). The spacer pedestals (20) are sized to protrude into the magazine space (17) sufficiently far to allow only a single line bullet clip (3) to fit in the pistol magazine (18). The pistol grip (19) may be attached by rivets or other devices associated with the particular pistol on which mounted. While a generally rectangular pistol magazine opening (21) is illustrated, other variations such as one or two circular or other shaped openings may also be used.

Figure 29:
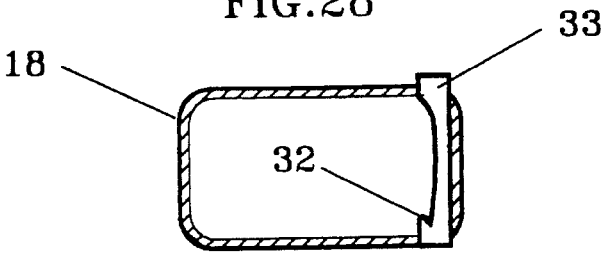
FIG. 29 illustrates the magazine catch and release.

In those instances of use of the pistol grip magazine adapter in high capacity magazine wells for which the magazine catch (32) is not long enough to engage the single stack capacity bullet clip (3) a modified catch (32) and release (33) must be installed in the pistol, reference FIG. 29.

Figure 26:
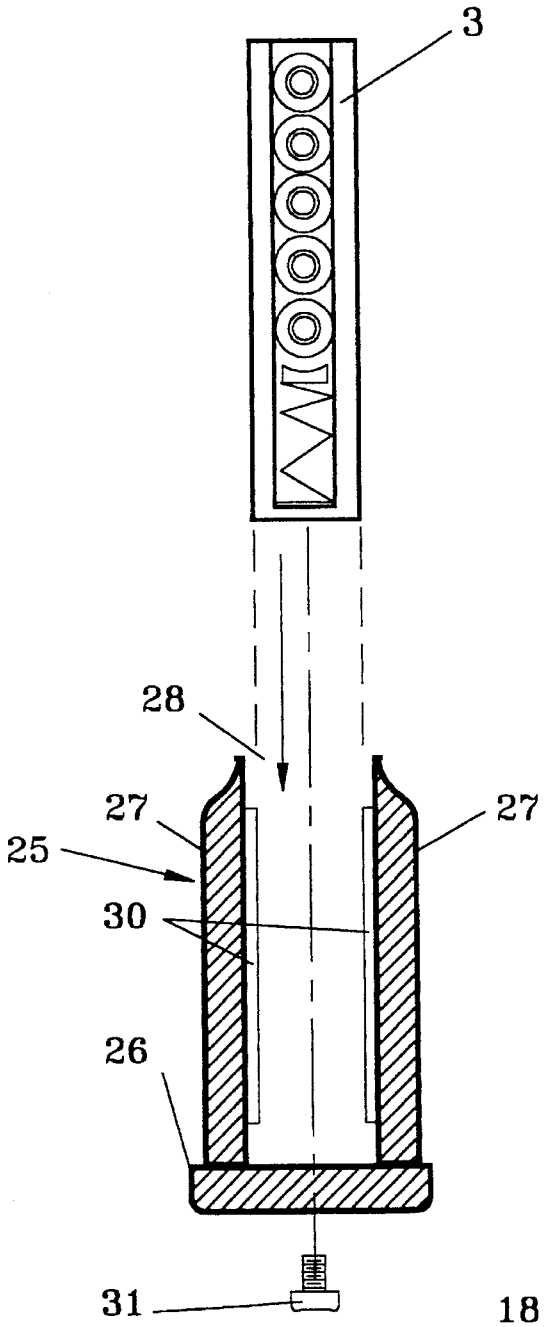
FIG. 26 illustrates a front view of a magazine clip adapter and clip to be installed.
Figure 27:
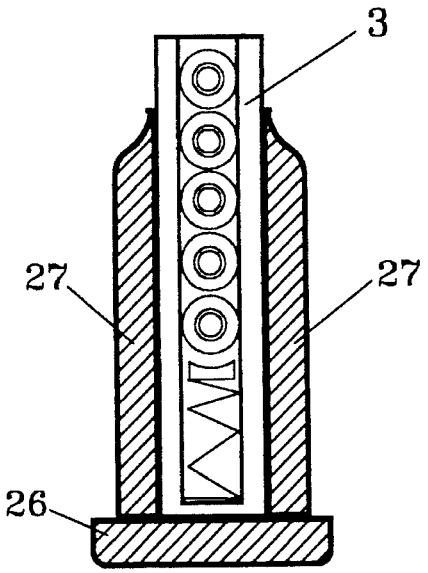
FIG. 27 illustrates a front view of a magazine clip adapter with clip installed.
Figure 28:
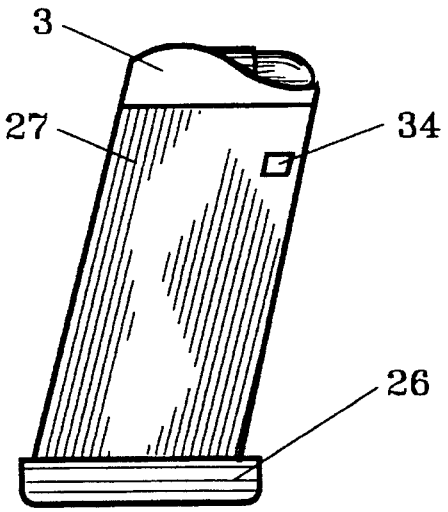
FIG. 28 illustrates a side view of a magazine clip adapter with clip installed.

Another alternate embodiment of the pistol grip magazine adapter is illustrated in FIGS. 26 through 28. In this embodiment the adapter is attached to the bullet clip (3). The magazine clip adapter (25) is generally rectangular in shape with a base pad (26) and two clip adapter sides (27). The base pad (26) is shaped to correspond to the particular pistol handle for the intended use. The clip adapter sides (27) are shaped to accept the intended bullet clip (3) in the clip aperture (28). One of the clip adapter sides (27) has a catch aperture (34) to engage the catch (32).

Figures 5, 18:
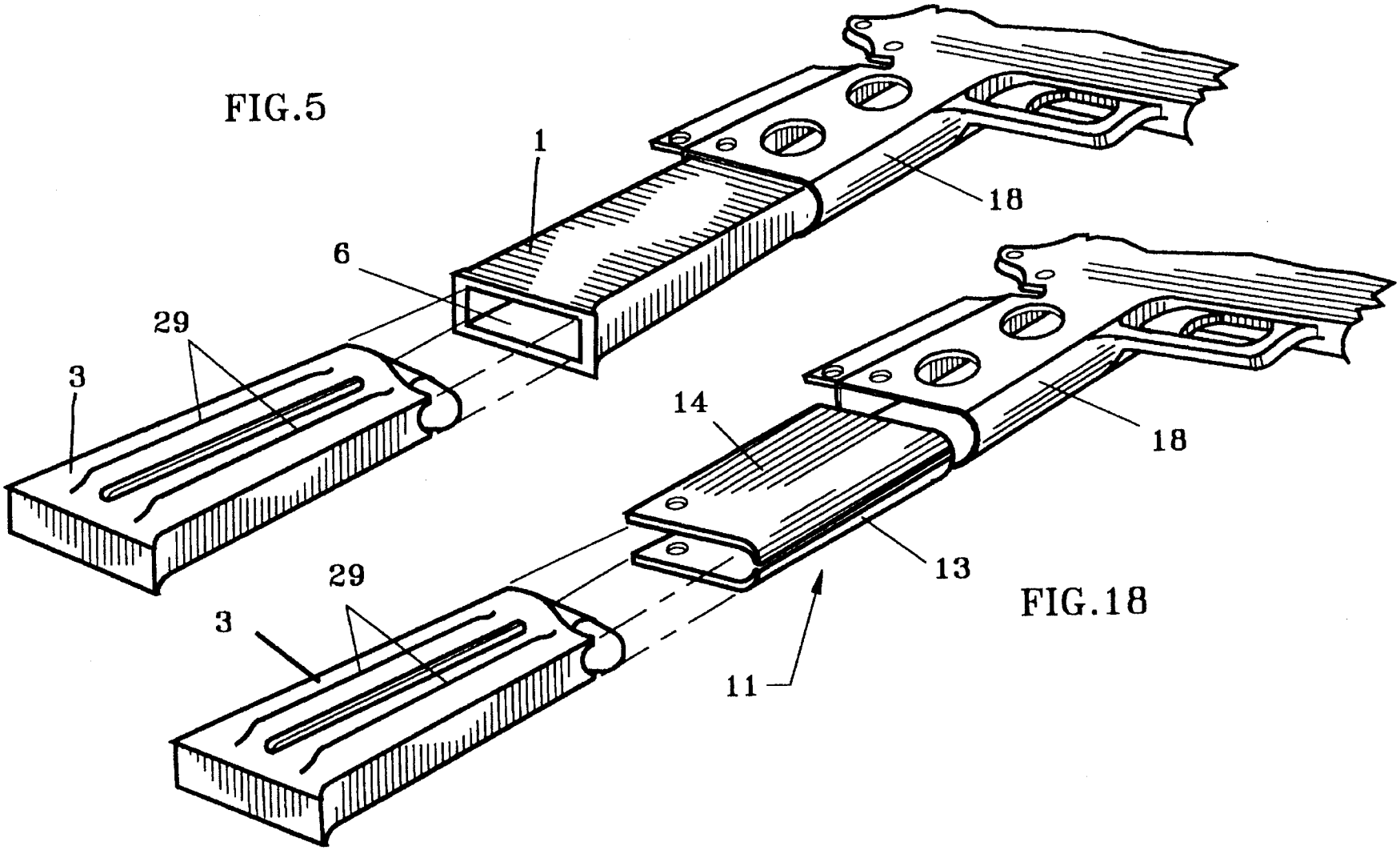
FIG. 5 illustrates a perspective view of the single magazine insert in a pistol magazine.
FIG. 18 illustrates a perspective view of the dual magazine insert in a pistol magazine.
Figure 12:
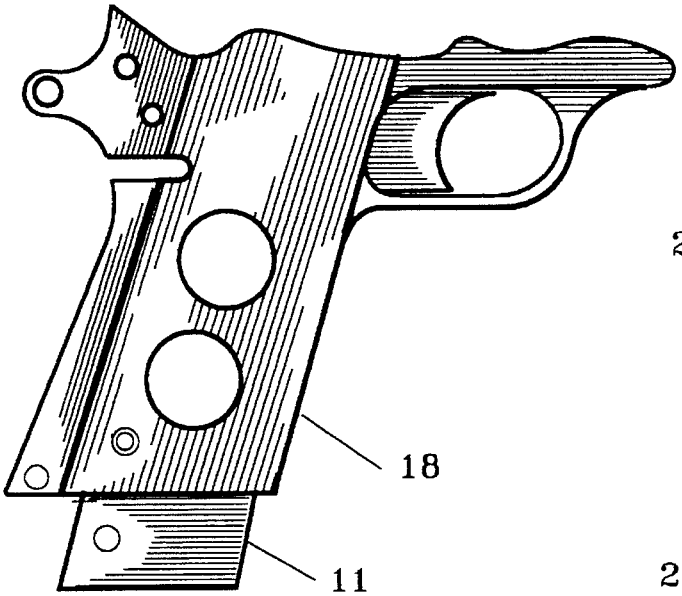
FIG. 12 illustrates a partial side view of a pistol handle with the dual insert partially inserted.
Figure 13:
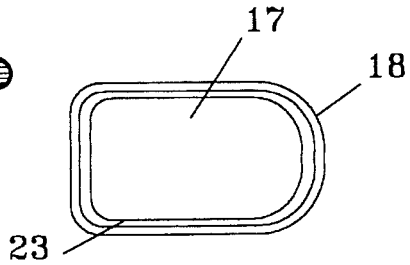
FIG. 13 illustrates a bottom view of a pistol handle magazine funnel.
Figure 14:
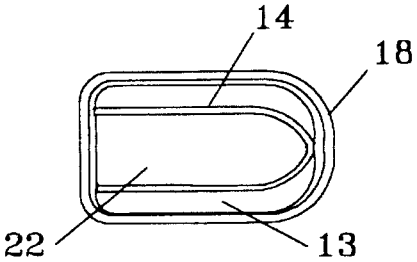
FIG. 14 illustrates a bottom view of a pistol handle magazine with dual inserts.
Figure 6:
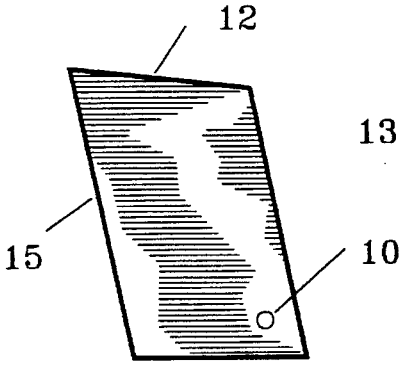
FIG. 6 illustrates a right side dual magazine insert side view.
Figure 8:
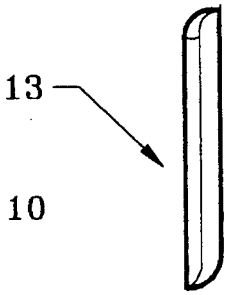
FIG. 8 illustrates a right side dual magazine insert end view.
Figure 10:
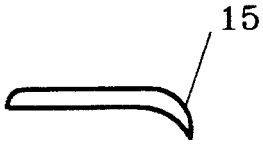
FIG. 10 illustrates a left side dual magazine insert top view.
Figure 7:
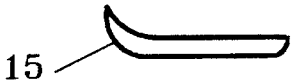
FIG. 7 illustrates a right side dual magazine insert top view.

For some single stack bullet clips (3) such as 38 caliber super clips, there are indentations (29) in the sides of the bullet clips (3) as illustrated in FIG. 18. For such bullet clips (3) corresponding ridges (30) are provided in the magazine clip adapter (25) to aid in retaining the clip. Other bullet clips (3) have smooth sides with no indentations. One or more clip screws (31) are used to retain the bullet clip (3) in the magazine clip adapter (25). Other attachment means may also be used such as rivets, glue, epoxy, welding, etc.

I claim:

1. A device for mounting in a hand gun handle magazine comprising:

a magazine clip adapter having a base pad with two clip adapter sides formed to fit against a magazine wall of the hand gun handle magazine;

the base pad having a clip screw to retain a bullet clip;

the magazine clip adapter having a volume to define a clip aperture therein into which said bullet clip may be loaded; and the magazine clip adapter being held in the magazine by an attachment means.

* * * * *